US005238088A

United States Patent [19]

Yoo

[11] Patent Number: 5,238,088

[45] Date of Patent: Aug. 24, 1993

[54] PIT BUFFER ASSEMBLY FOR HIGH SPEED ELEVATORS

[75] Inventor: Young S. Yoo, Avon, Conn.

[73] Assignee: Otis Elevator Company, Farmington, Conn.

[21] Appl. No.: 914,822

[22] Filed: Jul. 15, 1992

[51] Int. Cl.[5] ..... B66B 5/16

[52] U.S. Cl. ..... 187/79; 187/75; 187/77; 187/67

[58] Field of Search ..... 187/67, 75, 77, 79, 187/95

[56] References Cited

U.S. PATENT DOCUMENTS

| | | | |
|---|---|---|---|
| 249,076 | 11/1881 | Moulton | 187/67 |
| 568,345 | 9/1896 | Gilpin et al. | 187/67 |
| 692,888 | 2/1902 | Moses | 187/75 |
| 3,759,349 | 9/1973 | Sieffert | 187/67 X |

*Primary Examiner*—Robert P. Olszewski
*Assistant Examiner*—Dean A. Reichard
*Attorney, Agent, or Firm*—Richard D. Getz

[57] ABSTRACT

The cab or counterweight pit buffer for an elevator system includes a cross beam disposed in the pit below the ground floor landing for the elevator. The cross beam is mounted on the cab or counterweight guide rails by means of safety brakes which will allow limited and controlled downward movement of the cross beam when a downwardly directed force is exerted on it. The cross beam carries at least one plunger-type spring or oil buffer on its upper surface for initial engagement with the cab or counterweight in the event the latter must be stopped by the pit buffer. The majority of the braking force for the descending cab or counterweight is provided by the safety brakes on the buffer cross beam. The buffer assembly is particularly adapted for high speed elevator systems.

6 Claims, 2 Drawing Sheets

PIT BUFFER ASSEMBLY FOR HIGH SPEED ELEVATORS

TECHNICAL FIELD

This invention relates to an elevator cab or counterweight pit buffer assembly which is adapted for use with high speed elevator systems, and which does not require the use of an inordinately long or massive buffer piston.

BACKGROUND ART

In an elevator system, buffers are devices which are designed to stop a descending cab or counterweight that moves downwardly beyond its normal limit of travel. The buffers must be operable to produce an average retardation of 32.2 feet/sec/sec of the speed of the cab or counterweight. Elevator pit buffers are commonly spring buffers or oil buffers, the former being typically used for elevator speeds of up to 200 feet/min. and the latter for speeds above 200 feet/min.

It is readily apparent that the ability of the buffer to properly decelerate the cab or counterweight is difficult as elevator operating speed increases, and that the ultra high speed elevators (above 1800 feet/min.) which are highly desirable in high-rise buildings, require excessively long buffer pistons in order to operate properly. For example, an elevator operating speed of 2,500 feet/-min. would require a 428-inch stroke in order to meet the 32.2 feet/sec/sec retardation target referred to above, and a 3,000 feet/min. elevator would require a 616-inch minimum stroke. Elevator codes allow the reduction of the minimum buffer stroke when an emergency terminal speed limiting device, which senses the car speed and automatically removes power from the driving machine motor and brake if the normal terminal stopping device fails to slow down the car at the terminal as intended, is used on the cab and/or counterweight; however, the reduced stroke cannot be less than one-third of the minimum strokes specified above. Thus, the 2,500 feet/min. system would require a 143-inch stroke, and the 3,000 feet/min. system would require a 205-inch stroke. These stroke requirements exceed the longest buffer strokes available in the elevator industry, which is approximately 84 inches.

If one were to design a conventional type oil buffer for a 205-inch stroke, the overall height of the buffer would be more than 40 feet, and the pit depth needed to accommodate such a buffer would be several feet more. This adds considerable expense to the cost of the building. In addition, the buffer itself would be substantially more expensive than a conventional buffer because of the larger piston diameter that would be needed to meet the slenderness ratio (piston length over radius of gyration of piston cross section) of the longer column. Code requires that this ratio shall not exceed 80. Considerable development work would also be needed to design and test such a large-size oil buffer.

DISCLOSURE OF THE INVENTION

This invention relates to a pit buffer assembly for decelerating high speed elevator equipment, which buffer assembly does not require the use of excessively long buffer pistons and which utilizes conventional presently available elevator components in its construction. The buffer assembly of this invention includes a buffer beam mounted on the cab and counterweight guide rails approximately five feet below the bottom terminal floor. Each of the beams is connected to the guide rails by means of conventional safeties, as for example wedge safeties, which are sufficiently set so as to hold the beams in place on the guide rails. One or more small size conventional spring or oil buffers are mounted on the top surface of the buffer beam. The buffer beams are positioned so as to be aligned with the cab plank, and with the bottom of the counterweight frame in each case. The cab and counterweight are provided with safeties, such as wedge safeties for stopping and sustaining the entire car with its rated load from governor tripping speed. In the event that the cab or counterweight strikes the associated buffer beam by exceeding the speed set by the aforementioned emergency terminal speed limiting device, the oil or spring buffers mounted on the beam will initiate deceleration of the cab or counterweight, but the majority of the braking force will derive from the buffer beam safeties clamping onto the guide rails as the beam is driven by the descending cab or counterweight toward the pit floor. The braking action of the beam safeties decelerates and stops the cab or counterweight. When the cab or counterweight strikes the buffer beam, the cab or counterweight safeties will not be activated because the car speed is much lower than the governor tripping speed. The buffer assembly of this system thus derives all of its decelerating force from the fact that the buffer beam can move downwardly on the guide rails while being braked by the beam safeties. The safeties mounted on the beam are what is called the type B safeties which apply limited pressure on the guide rails with some flexible medium purposely introduced to control the retarding force and the stopping distance. The minimum distance that the buffer beam can move downwardly depends on the buffer striking speed which is set by the emergency terminal speed limiting device. For instance, the 2,500 feet/min. or 3,000 feet/min. car can be provided with a reduced buffer striking speed at 1,200 feet/min. and minimum stopping distances for the beam safeties would be 6'3". This braking action is distinctly different from the braking action provided in a temporary hoistway buffer system of the type shown in U.S. Pat. No. 3,759,349 granted Sep. 18, 1973 to J. E. Sieffert, where the buffer beam is fixed to and cannot move downwardly over the cab and counterweight guide rails.

It is therefore an object of this invention to provide a pit buffer assembly which utilizes conventional elevator components and which is adapted for use in ultra high speed elevator systems.

It is a further object of this invention to provide a buffer assembly of the character described which provides a deceleration buffer stroke of no more than approximately 30 feet for ultra high-speed elevators.

It is another object of this invention to provide a buffer assembly of the character described which utilizes conventionally sized spring or oil buffers as an operative component thereof.

These and other objects and advantages of the invention will become more readily apparent from the following detailed description of a preferred embodiment thereof when taken in conjunction with the accompanying drawings in which:

BEST MODE FOR CARRYING OUT THE INVENTION

Figure 1:
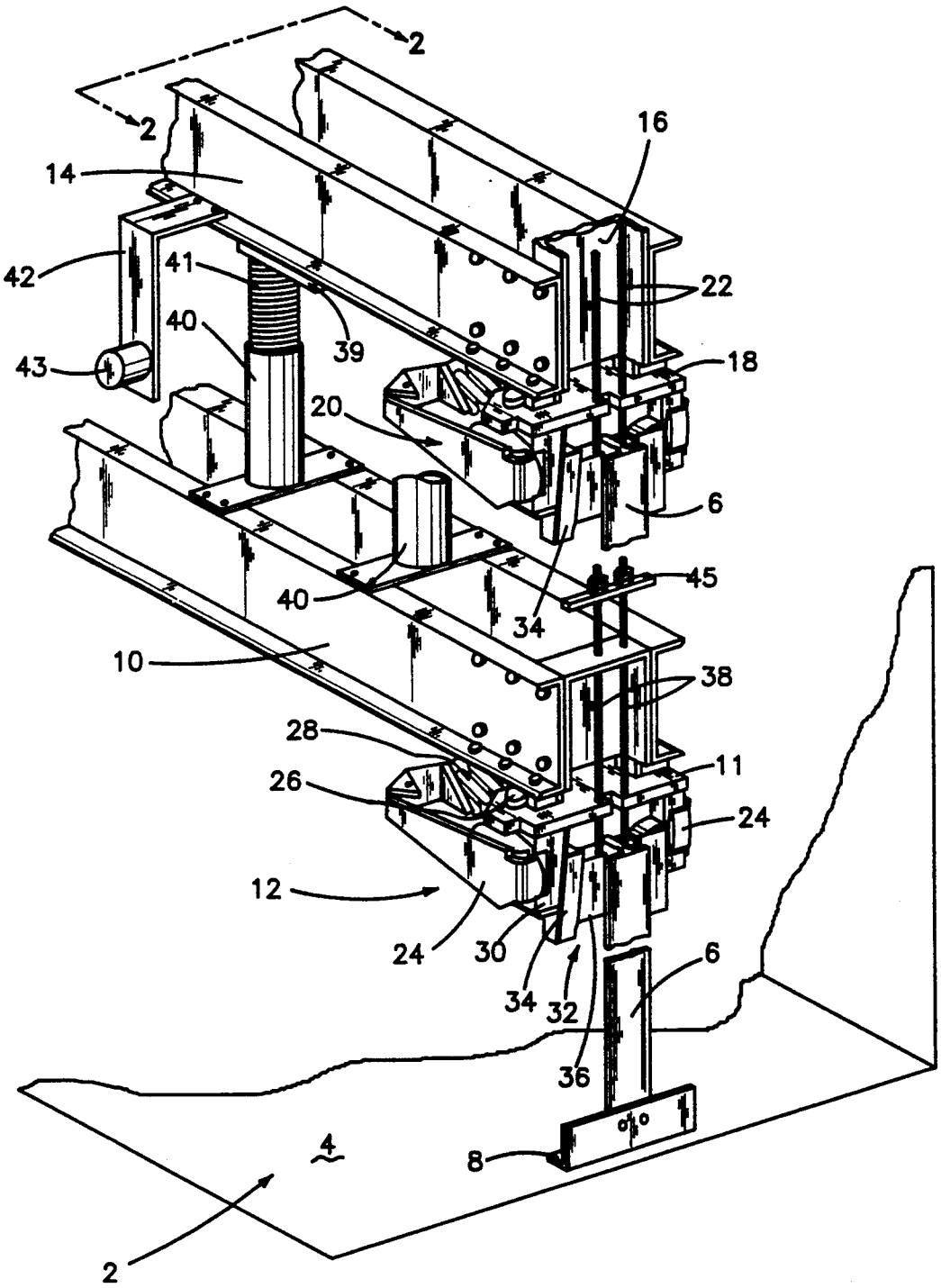
FIG. 1 is a fragmented projective view of a preferred embodiment of a cab pit buffer assembly formed in accordance with this invention.

Referring now to the drawings, there is shown a preferred embodiment of a cab pit buffer assembly formed in accordance with this invention. The hoistway is denoted generally by the numeral 2, and the hoistway pit floor is denoted by the numeral 4. A cab guide rail 6 is mounted on one side wall of the hoistway 2 and secured to the pit floor 4 by a bracket 8. A pit buffer beam 10 is mounted on the rail 6, and on a complementary rail secured to the opposite side wall of the hoistway (not shown) by means of a safety brake assembly 12 mounted on a safety bracket 11 secured to the buffer beam 10. The pit buffer beam 10 underlies and is aligned with the cab frame plank 14 which forms the lowermost component on the elevator cab frame with the exception of compensation sheave and sheave frame assembly. The plank 14 is secured to side stiles 16 on the frame and is bolted to a safety bracket 18, on which the cab safeties 20 are mounted. Both of the safety assemblies 12 and 20 are essentially identical, the difference being only that the safeties 12 on the buffer beams 10 are preset on the rails 6, while the safeties 20 on the cab plank 14 must be set by pulling on governor cable rods 22.

Each safety assembly 12 and 20 includes a pair of retention arms 24 which are pivoted about pins 26 mounted in the brackets 11 and 18. A coil spring 28 biases the arms 24 about the pins 26. The arms 24 carry backup plates 30 which grip wedge pairs 32 that straddle the guide rail 6. The wedge pairs 32 include complementary wedge-shaped elements 34 and 36, the outermost of which 34 is supported by the plates 30 and the innermost of which 36 are disposed adjacent to the guide rail 6. Safety reset rods 38 are connected to the inner elements 36 and extend upwardly through the buffer beam 10 and toward the cab frame plank 14. A pair of spring or oil buffers 40 are mounted on the top of the buffer beam 10 and extend toward the frame plank 14.

The device operates as follows. When the cab descends into the pit because the car exceeds the preset slowdown speed, the plank 14 will first contact the buffers 40 whereby the energy of the descending car due to the initial impact will be dissipated and deceleration will begin and the springs will be compressed solid. The cab assembly will continue to descend in the pit, causing the buffer beam 10 to be moved over the guide rails 6 toward the floor 4 of the pit. This movement of the buffer beam 10 will increase the braking action of the buffer beam safeties 12 on the guide rails 6 which will increase the deceleration of the cab assembly. As previously noted, the buffer beam 10 will drop a maximum of 6 feet 3 inches during the complete deceleration and stopping of the cab assembly for a reduced buffer strike speed of 1,200 feet/min. Since the initial speed is 1,300 feet/min (or 20 feet/sec.), the distance traveled at 32 feet/sec.$^2$ retardation (average) would be $$S = \frac{(20 \text{ feet/sec})^2}{2 \times 32.2 \text{ feet/sec}^2} = \frac{400}{64.4} = 6 \text{ feet } 3 \text{ inches}$$

Figure 2:
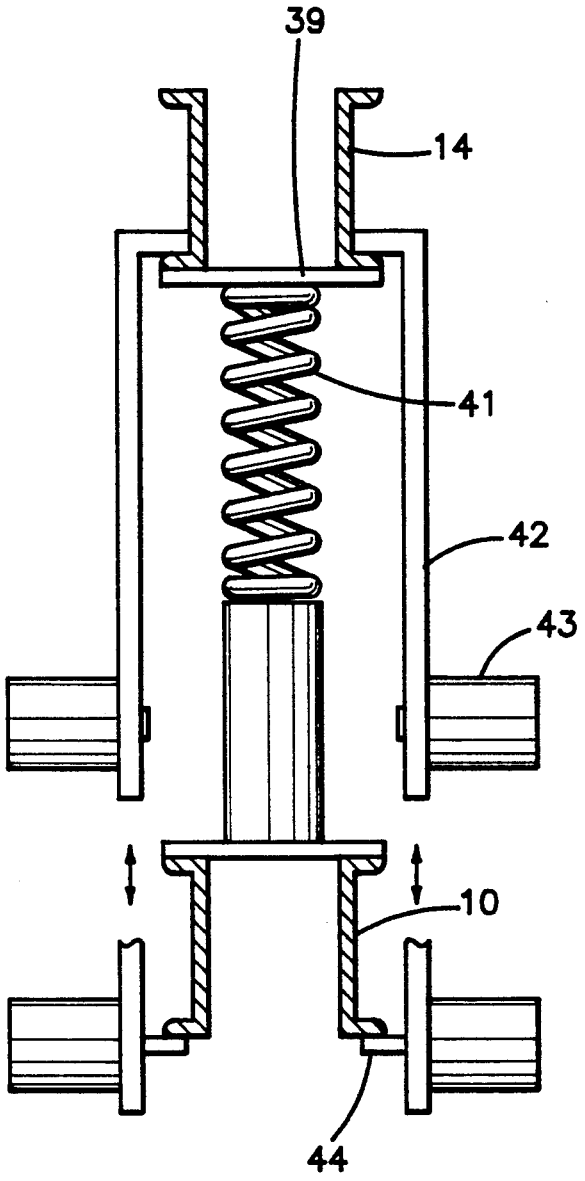
FIG. 2 is a view of a wedge engaging and disengaging mechanism.

When the cab plank 14 drops onto the buffer beam 10, reset arms 42 which descend downwardly from both sides of the plank 14 and will move past each side of the buffer beam 10, as shown in FIG. 2. A strike plate or plates 39 mounted on the plank 14 will engage springs 41 and compress the latter. Catch pins 44, which are selectively operated by solenoids 43, will be extended beneath the buffer beam 10, as shown in FIG. 2. After braking of the cab has been completed, and the latter is to be lifted up from the pit, the catch pins 44 will cause the buffer beam 10 to be lifted along with the cab assembly. Upward movement of the buffer beam 10 will release the safeties 12. Once the safeties 12 are released, the stops 45 on the rods 38 will keep the wedges 36 suspended from the beam 10.

After the car is positioned to the proper bottom floor level, the stops 45 will be moved to their original positions, and the buffer beam 10 will be released from the reset arms 42 and lowered. The wedges 32, 36 will provide frictional forces to retain the buffer beam assembly at about the same height in the pit. The stop pins 44 can be moved in and out by using a solenoid or they can be set manually. In a similar manner, the stops 45 can be held or released to the cab assembly automatically by using a solenoid or manually. The above reset mechanism can also be accomplished by providing a proper mechanism without using solenoids.

Since many changes and variations of the disclosed embodiment of the invention may be made without departing from the inventive concept, it is not intended to limit the invention otherwise than as required by the appended claims.

What is claimed is:

1. An elevator hoistway pit buffer assembly for decelerating downward movement of an elevator cab, said assembly comprising:

a) elevator cab guide rails mounted on opposite sides of the hoistway for guiding vertical movement of the cab in the hoistway;

b) a beam extending across the hoistway beneath the cab, said beam being disposed beneath the lowermost landing in the hoistway; and c) safety brake assemblies on either end of said beam, said safety brake assemblies supporting said beam on said guide rails, said safety brake assemblies being operable to hold said beam in a predetermined location on said guide rails during normal operation of the elevator and further being operable to provide controlled decelerated downward movement of said beam when the latter is struck by a descending elevator cab which will halt downward movement of the elevator cab above the pit floor.

2. The buffer assembly of claim 1, further comprising an auxiliary buffer mounted on said beam for providing an initial incremental deceleration of the cab before the latter strikes said beam.

3. The buffer assembly of claim 1, wherein said safety brake assemblies comprise a pair of wedge blocks mounted on opposite sides of each guide rail, said wedge blocks in each pair including an inner wedge block contacting the guide rail, and an outer wedge block abutting said inner wedge block, said outer wedge blocks being mounted in respective retention arms that are partially disposed on said beam; and spring means engaging said retention arms for urging said outer wedge blocks against said inner wedge blocks.

4. The buffer assembly of claim 3, further comprising brake reset means secured to said inner wedge blocks and said beam, said reset means being engageable by a portion of the cab for releasing said inner wedges from the rail to allow return of the beam to its initial position within the hoistway after activation of the buffer assembly by a descending cab.

5. The buffer assembly of claim 1, wherein the cab includes a lowermost member having a downwardly extending reset means for selectively locking onto said beam, and for lifting said beam to its initial position when the cab is raised after activation of the buffer assembly.

6. The buffer assembly of claim 1, wherein said safety brake assemblies include means operable to stop an elevator cab moving at a speed of 1,200 feet/min. over a minimum beam downward travel distance of about 6 feet, 3 inches.

* * * * *